United States Patent [19]

Pinner et al.

[11] Patent Number: 4,611,462

[45] Date of Patent: Sep. 16, 1986

[54] OPEN-END SPINNING MACHINES

[75] Inventors: Vernon G. Pinner, Burnley; John Richardson, Oldham, both of England

[73] Assignee: 501 Hollingsworth (UK) Limited, Accrington, England

[21] Appl. No.: 659,596

[22] Filed: Oct. 11, 1984

[30] Foreign Application Priority Data

Oct. 12, 1983 [GB] United Kingdom ..... 8327290

[51] Int. Cl.[4] ..... D01H 13/26; D01H 15/02

[52] U.S. Cl. ..... 57/263; 57/78; 57/100

[58] Field of Search ..... 57/78, 83, 92, 93, 100, 57/262, 263, 261

[56] References Cited

U.S. PATENT DOCUMENTS

| | | | |
|---|---|---|---|
| 3,455,095 | 7/1969 | Makeham et al. | 57/263 |
| 3,678,673 | 7/1972 | Prochazka et al. | 57/263 X |
| 3,680,300 | 8/1972 | Landwehrkamp | 57/263 |
| 3,733,799 | 5/1973 | Roethke | 57/263 |
| 3,803,823 | 8/1974 | Niestroj et al. | 57/263 |
| 4,022,011 | 5/1977 | Hirai | 57/263 |
| 4,054,024 | 10/1977 | Tsubata et al. | 57/263 X |
| 4,083,169 | 8/1978 | Lane et al. | 57/263 |
| 4,228,642 | 10/1980 | Dakin et al. | 57/263 |

FOREIGN PATENT DOCUMENTS

| | | | |
|---|---|---|---|
| 2019451 | 10/1979 | United Kingdom | 57/263 |

*Primary Examiner*—Billy S. Taylor
*Assistant Examiner*—Joseph J. Hail, III
*Attorney, Agent, or Firm*—Cort Flint

[57] ABSTRACT

An open-end spinning machine is disclosed having a piecing ability employing both a yarn reserve-forming member as well as reverse rotation of the yarn withdrawal rollers and of the package drive roll to pay out yarn from the package during formation of the yarn reserve, during the start-up cycle. This permits rapid dispensing of the yarn reserve on piecing, while allowing the reserve to be formed at a controlled rate before start-up and thereby minimizing the load on any auxiliary power source taking over in the event of shutdown of a multi-station spinning machine on power failure.

9 Claims, 1 Drawing Figure

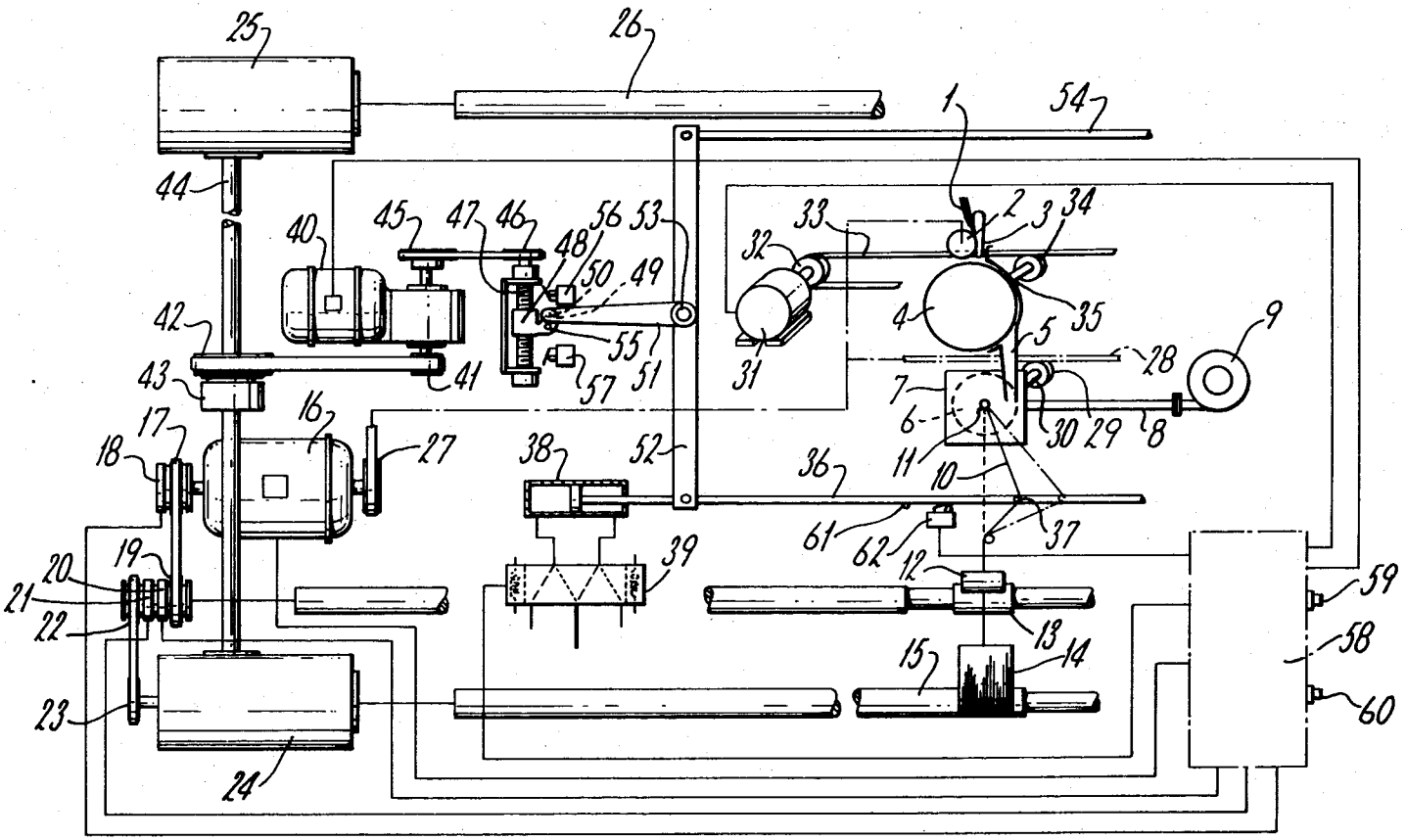

OPEN-END SPINNING MACHINES

BACKGROUND OF THE INVENTION

1. Field of the Invention

This invention relates to open-end spinning machines for producing textile yarns, and particularly to a method and apparatus for starting a spinning operation in an open-end spinning machine.

2. Description of the Related Art

In British Pat. No. 2,019,451 there are described two starting procedures for an open-end spinning machine.

The first, shown in FIG. 1, uses reversal of the yarn delivery rollers at a controlled rate to re-introduce the end of the yarn into the spinning chamber at a controlled rate to effect piecing. Upon completion of piecing, the rollers rotate in the yarn withdrawal direction and normal spinning resumes.

In the second entirely different described procedure, shown in FIG. 3 of British Pat. No. 2,019,451, a retractable yarn guide is used for forming a reserve loop of yarn upstream of the delivery rollers, and the piecing operation later involves the step of shortening the reserve length of yarn so as to enable the end of yarn to move to the fibre collecting surface of a spinning rotor and twist in the fibres fed thereto. The step of forming the reserve length of yarn in this second procedure conveniently takes place during the the preceding stopping procedure by engagement of the yarn with the reserve forming member which is caused to move in a longitudinal direction at a slow rate of traverse.

It has been found to be disadvantageous in some situations to form the reserve length of yarn during the stopping procedure. It is, of course, a requirement of a satisfactory stopping procedure that, upon the termination of a spinning operation, all of the ends of yarn are at a position in which they can be returned automatically to the spinning rotor, and that the various fibre and yarn handling components are stopped in accordance with a predetermined programme. However it has been found difficult to accomplish this stopping programme in the event of a failure in the supply of electrical power to the machine, even when an auxiliary source of electrical power, such as, for example, batteries, can be utilised upon such power failure. It is therefore advantageous if the stopping prodedure can be shortened so that the auxiliary source is capable of supplying electrical power for a sufficient length of time for a satisfactory stopping procedure to be carried out.

One way of achieving a shortened stopping procedure is to omit from it the step of forming the reserve length of yarn and to include this step in the starting procedure as disclosed in the first of the two procedures disclosed in British Pat. No. 2,019,451. Moreover, this has the disadvantage that the reversal of the yarn package, finding of the yarn end, and delivery of it to the spinning chamber all occur in a continuous sequence and, as a result prolong the piecing procedure.

SUMMARY OF THE INVENTION

According to a first aspect of the invention a method of starting a spinning operation in an open-end spinning machine, which includes spinning means; fibre feed means for feeding fibres to the spinning means; yarn take-up means including yarn delivery rollers, and a yarn take-up package, rotatable in a first direction so as to deliver yarn from the spinning means; and yarn reserve-forming means to form a yarn reserve loop to be delivered to the spinning chamber for piecing; is characterised by rotating the yarn take-up means in a second direction opposite the direction to pay out yarn from the package, and simultaneously actuating the yarn reserve forming means to from a reserve length of yarn in its path between the spinning means and the yarn take-up means, from for yarn withdrawn the yarn package, then releasing the reserve length of yarn to enable an end thereof to return to the spinning means so as to twist in fibres fed thereto by the fibre feed means, and then rotating the yarn take-up means in the first direction so as to deliver yarn from the spinning means.

According to a second aspect of the invention, apparatus for starting a spinning operation in an open-end spinning machine comprises spinning means; fibre feed means for feeding fibres to the spinning means; yarn take-up means including yarn delivery rollers and a yarn take-up package; drive means for rotating the yarn take-up means in a first direction so as to deliver yarn from the spinning means; and yarn reserve-forming means for forming a reserve length of yarn in the yarn path extending between the spinning means and the yarn take-up means, characterized by control means to cause the drive means to rotate the yarn take-up means in a reverse direction and to cause simultaneous movement of the yarn reserve-forming means to form the reserve length of yarn from withdrawn from the yarn package, and for subsequently causing movement of the yarn reserve forming means to pay out the reserve length.

THE DRAWING

An embodiment of the invention will now be described, by way of example, with reference to the accompanying drawing which shows, schematically, an open-end spinning machine according to the invention.

DESCRIPTION OF A PREFERRED EMBODIMENT

Only one spinning station is described hereinafter, but it will be appreciated that the machine comprises a plurality of such stations at spaced locations along each side of the machine.

Referring to the drawing, at each spinning station a sliver 1 is forwarded between the nip formed by a feed roller 2 and a feed plate 3 to the action of an opening roller 4. The fibres are removed from the opening roller 4 and transferred in an airstream down a fibre feed duct 5 to a spinning rotor 6. The spinning rotor 6 is mounted for rotation within a housing 7 having connected thereto a suction pipe 8 communicating with a suction fan 9 from which the fibre conveying air stream in the fibre feed duct 5 is derived. Spun yarn 10 is withdrawn from the spinning rotor 6 through a doffing tube 11 by a pair of delivery rollers 12, 13 and wound up on a package 14 driven by a package driving roller 15.

A main drive motor 16 has a driving pulley 17 and a clutch 18 fixed to the output shaft thereof. The driving pulley 17 is drivingly connected to a driven pulley 19 mounted on an extension of the delivery roller 13 of each spinning station. Also mounted on the delivery roller extension is an electromagnetic brake 21, an electromagnetic clutch 20, and a driving pulley 22 which is drivingly connected to a driven pulley 23 mounted on an input shaft of an anti-patterning gearbox 24. The output shaft of the anti-patterning gearbox 24 is coupled to the package driving roller 15 of each spinning station.

The main drive motor 16 also serves to drive in a similar manner the delivery rollers (not shown), the anti-patterning gearbox 25 and the package driving roller 26 serving the spinning stations (not shown) along the other side of the machine.

On a further output shaft of the main driving motor 16 is a drive pulley 27 from which a drive transmission is taken so as to drive a belt 28. This belt 28 contacts a pulley 29, and also the corresponding pulleys at remaining stations, fixed to a shaft 30 upon which there is mounted the spinning rotor 6 whereby rotation is imparted thereto. The main driving motor 16 also serves to drive in a similar manner the spinning rotors (not shown) at the spinning stations extending along the other side of the machine. The drive for the rotation of the feed rollers 2 serving the spinning stations on both sides of the machine is also derived from the main drive motor 16.

The drive for the opening roller 4 is derived from an opening roller motor 31 on the output shaft of which is mounted a pulley 32. The pulley 32 drives a belt 33 which extends along the machine and at each station contacts a pulley 34 fixed to a shaft 35 upon which is mounted the opening roller 4. Rotation of the opening rollers serving the spinning stations extending along the other side of the machine is also derived from the motor 31 in a manner not shown.

At each spinning station there is provided the facility for forming a reserve length of yarn for the purpose to be hereinafter described. A reserve length forming bar 36 extends along the machine and is provided at a position corresponding to a spinning station with a yarn engaging member 37. Longitudinal movement of the bar 36 is derived from a pneumatic cylinder 38. Air is supplied to and exhausted from this cylinder by means of a control valve 39. Movement of the bar 36 to the right, as viewed in the drawing, causes engagement of the yarn engaging member 37 with the yarn 10 so as to form a reserve length of yarn, as indicated by the chain-dot line. Upon starting a spinning operation the reserve length of yarn is depleted by causing the bar 36 to move to the left so as to enable the end of the yarn 10 to contact and twist in the fibres on the fibre collecting surface of the spinning rotor 6. The solid line shows the magnitude of the yarn reserve loop with the reserve yarn length forming bar 36 partway through its leftward movement to pay out reserve yarn during the piecing operation. The yarn 10 eventually follows the shortened spinning path during normal spinning as indicated by the broken line. The amount of yarn required to form the reserve length is provided by withdrawing yarn for the yarn package 14. This is achieved by rotating the package driving roller 15 and the yarn delivery rollers 12, 13 in a direction opposite to that which is required to deliver spun yarn from the spinning rotor 6.

For this purpose the machine is provided with a geared motor reduction unit 40 having a drive pulley 41 mounted on an output shaft of the unit. The drive pulley 41 is drivingly connected to a driven pulley 42 which drives, through an electromagnetic tooth clutch 43, a cross shaft 44. The cross shaft 44 is connected to each of the gearboxes 24, 25 to provide a drive input to them, by means of which the package driving roller 15 and the delivery rollers 12, 13 through the pulleys 22, 23, can be driven in a direction opposite to that which is required to deliver yarn from the spinning rotor 6.

The rate of movement of the bar 36 must be such that it forms the reserve length of yarn at a controlled rate in accordance with the rate at which yarn is withdrawn from the package 14. This is achieved by utilizing output drive from the geared motor reduction unit 40, which is provided with a further drive pulley 45 drivingly connected by a belt with a driven pulley 46. The pulley 46 is mounted at one end of a lead screw 47 which supports for movement therealong a traverse nut 48. The traverse nut 48 is provided with a projection 49, which during formation of the reserve length of yarn, bears against a boss 50 provided on one end of a control lever 51. The other end of the control lever 51 is fixedly attached to a cross member 52 at a mid-way position coinciding with a fulcrum position 53 of the cross member. One end of the cross member 52 is pivotally attached to the bar 16 and the other end of the cross member 52 is pivotally attached to a bar 54 serving the spinning stations along the other side of the machine. A projection 49 of the traverse nut 48 has a depending pin 55 which is arranged to actuate a micro switch 56 on reaching one end of the lead screw 47 and to actuate a micro-switch 57 on reaching the other end of the lead screw 47. The micro-switches 56, 57 are operatively connected with the motor unit 40 and the clutch 43.

The operation of the machine is controlled from a control circuit, generally indicated at 58, provided with a start button 59 and a stop button 60. The control circuit 58 includes means, for example a stepping switch, connected with the various electrically operated elements so that they can be controlled in a predetermined manner.

The machine operates in the following manner; When it is desired to stop the machine, the stop button 60 is depressed so that the control circuit controls automatically the stopping of the machine in accordance with a predetermined sequence. The main driving motor 16 decelerates and, in consequence thereof, the feed roller 2, the delivery rollers 12, 13 and the package driving roller 15 also decelerate. At a predetermined slowed speed of the delivery rollers the feed rollers 2 are stopped thereby terminating the feed of fibres to the spinning rotor 6. At a predetermined period of time after stopping the feed rollers 2, the delivery rollers 12, 13 and the package driving roller 15 are stopped thereby terminating delivery of spun yarn from the rotor 6.

To start the machine the suction fan 9 is first switched on to apply suction to the rotor housing 7. A machine isolator (not shown) is actuated to energize the brake 21 and to start operation of the main drive motor 16. The reserve length forming bar 36 is in its extreme left position to permit the yarn 10 to follow the shortened path, and thus the free end of the control lever 51 is at that end of the lead screw 47 corresponding to the micro-switch 56, whilst the traverse nut 48 is at the other end of the lead screw 47. The start button 60 is depressed and the geared motor 40 is operated so as to rotate the lead screw 47 in a direction to cause the traverse nut 48 to move along the screw 47 so that the projection 49 comes into contact with the boss 50. The clutch 43 is in the disengaged position so that there is no drive to the delivery rollers 12, 13 or the package driving roller 15. In this position the pin 55 contacts the micro-switch 56 which initiates stoppage of the geared motor 40. The main drive motor 16 runs up to the operating speed, with the clutch 18 and the clutches (not shown) in the drive transmissions to the spinning rotor 6 and the feed rollers 2 in their disengaged positions.

Operation of the control valve 39 is initiated so as to permit pressurised air from the main air supply to enter the cylinder 38 so as to tend to move the bar 36 towards the right. Simultaneously, the geared motor 40 is operated so as to rotate the lead screw 47 in a direction to cause the traverse nut 48 to move towards the micro-switch 57. The pressurized air within the cylinder 38 acts through the cross member 52 and the control lever 51 to press the boss 50 into engagement with the projection 49 and thus the rate of movement of the bar 36 is dependent on the rate of movement of the traverse nut 48 along the lead screw 47. It will be apparent that the bar 54 serving the spinning stations along the other side of the machine is similarly controlled.

With the clutch 43 in the engaged condition, the drive from the pulley 41 is transmitted by means of the pulley 42 so as to rotate the cross shaft 44 thereby providing a drive input to the gearboxes 24, 25. An output drive from the gearbox 24 produces a rotation of the package driving roller 15 in a direction opposite to that required to accumulate yarn 10. Simultaneous reverse rotation of the delivery rollers 12, 13 is effected from the gearbox 25 by means of the pulleys 23 and 22, with the clutch 20 in the engaged condition and the brake 21 in a disengaged condition. The yarn withdrawn from the yarn package 14 by the reverse rotation of the package driving roller 15 and the delivery rollers 12, 13 is formed simultaneously into a reserve length, as shown by the chain-dot line, at a controlled rate by the bar 36. The reserve length formation takes place quite slowly and, for example, the bar 36 takes 20 seconds to move 4.5 inches, and the package driving roller 15 and the delivery roller 13 rotate in the reserve direction at 1.6 r.p.m.

At the termination of forming the reserve yarn length the pin 55 on the control lever 51 actuates the micro-switch 57 to stop the geared motor 40. The clutches 43 and 20 are disengaged, the brake 21 is actuated to stop rotation of the package driving roller 15 and the delivery rollers 12, 13, and the control valve 39 stops the supply of pressurized air to the cylinder 38. A projection 61 on the bar 36 actuates a micro-switch 65 to initiate operation of the control circuit 58 so that the succeeding steps take place automatically.

A clutch (not shown) in the drive transmission to the spinning rotor 6 is engaged so that the output drive from the main driving motor 16 is transmitted from the pulley 27, through the driving belt 28, the pulley 29, and the shaft 30 to the spinning rotor 6. This is followed by starting the opening roller motor 31 thereby causing rotation of the opening roller 4 by means of the pulleys 32, 34, and the driving belt 33.

The feed of the sliver 1 by rotation of the feed roller 2 is then commenced by engagement of a clutch, not shown. in the drive transmission from the main drive motor 16 so that fibres are supplied to the opening roller 4 and then along the fibre feed duct 5 into the spinning rotor 6 where they accumulate at the fibre collecting surface thereof.

The control valve 39 is then actuated so as to permit the supply of pressurized air to the cylinder 38 so as to cause the bar 36 to move to the left to permit the yarn to follow the shortened path, i.e. the normal spinning path, as indicated by the broken line. Since movement of the control lever 51 is unrestrained by the traverse nut projection 49, this movement of the bar 36 takes place quickly and in so doing it reduces the length of the reserve loop of yarn 10 by the leftward movement of the yarn engaging member 37 to allow the yarn end to return to the fibre collecting surface of the spinning rotor 6 at a controlled rate where it contacts and twists in the fibres fed thereto. Withdrawal of the spun yarn 10 is effected by energisation of the clutch 20 and the de-energisation of the brake 21 to cause rotation of the delivery rollers 12, 13 and also rotation of the package driving roller 15 in a direction so as to deliver spun yarn from the spinning rotor 6 and to accumulate it on the package 14.

This invention enables a reserve length of yarn to be formed during a machine starting procedure so that the number of steps required during the stopping procedure is, as a consequence, reduced. A significant advantage of this is that the auxiliary source of electrical power, brought into operation upon failure of the main electrical power source, can satisfactorily supply electricity for a sufficient period of time to enable a satisfactory stopping procedure to be carried out. The above-described piecing procedure enables rapid dispensing of the yarn reserve to contact the collecting fibres within the rotor at an optimum rate for piecing. However, the more time-consuming operations of reversing the package, finding the loose end of yarn on the package, and guiding it into the yarn delivery roller nip can be carried out in a slow and controlled manner, and the yarn reserve forms at a correspondingly slow rate, without unduly lengthening the total piecing cycle because this yarn end finding operation can coincide with other preparatory operations.

We claim:

1. In means for starting a yarn spinning operation in an open-end spinning machine, said machine comprising (a) spinning means for spinning yarn; (b) fibre feed means for feeding fibres to said spinning means; (c) yarn take-up means for receiving said spun yarn including yarn delivery rollers, a yarn take-up package onto which said spun yarn is wound, and means for establishing a yarn path therebetween; (d) drive means for driving in rotating said yarn take-up means including said delivery rollers and said yarn package in a first direction for delivering said spun yarn from said spinning means to said package; and (e) yarn reserve-forming means for forming a reserve length of yarn in said yarn path between said package and said spinning means; the improvement comprising:

i. said yarn reserve-forming means being effective to form said reserve length of yarn between said yarn delivery rollers and said spinning means; and ii. control means for controlling said drive means to rotate said yarn take-up means at a controlled first rate in a second direction opposing said first direction, and for controlling and causing a simultaneous movement of said reserve-forming means in a direction effective to form said reserve length of yarn from said spun yarn wound onto said package and further for controlling and causing movement of said yarn reserve-forming means at a controlled second rate in a direction effective to pay out the thus-formed reserve length of yarn at a controlled rate.

2. Improved means according to claim 1, including mechanical drive connection means for linking said yarn reserve forming means with said yarn take-up means for ensuring movement of said yarn reserve-forming means during a building phase of said reserve length of yarn at said first controlled rate of movement thereof in accordance with said rate of paying out of yarn from said package upon motion of said yarn take-up means in said second direction.

3. Improved means according to claim 1, wherein said open-end spinning machine is a multi-station machine, the stations of which have a common yarn reserve-forming means, a common drive to said yarn take-up means of each of said spinning stations, common drive means to said various spinning means, and common control means for effecting piecing simultaneously at each of said spinning stations on start-up.

4. Improved means for starting a spinning operation in an open-end spinning machine, including (a) spinning means for spinning a yarn;

(b) fibre feed means for feeding fibres to said spinning means;

(c) yarn take-up package means for taking-up or receiving said spun yarn, including a pair of yarn delivery rollers and a yarn take-up means spaced from said rollers to define therebetween space for a yarn path extending therebetween;

(d) drive means for rotating said yarn take-up means in a first direction to receive and deliver said yarn from said spinning means;

(e) yarn reserve-forming means for forming a reserve length of yarn to be used in said starting, said forming means including a drive arm, and effective for forming said reserve length of yarn within said space in a yarn path between said yarn delivery rollers and said spinning means;

(f) mechanical drive connection means for interconnecting said yarn reserve-forming means with said yarn take-up means for ensuring movement of said yarn reserve-forming means during a building phase of said reserve length of yarn at a controlled rate in accordance with the rate of paying out said yarn from said package upon motion of said yarn take-up means in a second direction opposite to said first direction; and (g) control means for controlling said drive means to rotate said yarn take-up means at a controlled first rate in said second direction opposite to said first direction, for controlling and causing simultaneous movement of said reserve-forming means in a direction so as to form said reserve length of yarn from said payed out yarn withdrawn from said yarn package, and for controlling and causing movement of said yarn reserve-forming means in another direction so as to pay-out the thus-formed reserve length of yarn;

wherein said mechanical drive connection means includes a lead screw and a nut thereon which is engageable with said drive arm;

wherein said lead screw there is an auxiliary motor interconnected with said lead screw for driving the same, and interconnected also with said yarn take-up means for driving it in said second direction, the driving of said yarn take-up means in said first direction being effected by a main motor separate from said auxiliary motor; and wherein unidirectional engagement means are provided for interconnecting said nut and said drive arm for unidirectioally engaging said nut with said drive arm for positively driving said yarn reserve-forming means in a direction corresponding to paying out of the yarn reserve length but whereby movement of said nut in the opposite direction can occur independently of said drive arm; and wherein biasing means are provided for the biasing of said drive arm against said nut to effect the controlled movement of said drive arm and said yarn reserve-forming means in the reserve-building direction at a rate permitted by the retreating movement of said nut, said biasing means being controllable to drive said drive arm and said yarn reserve-forming means freely in said direction corresponding to paying out of said yarn reserve length without any restraining action on the part of said nut, and whereby said reserve length of yarn is formed at a first speed and is payed out at a second higher rate of speed.

5. Improved means according to claim 4, further including first and second limit switches cooperable with said nut and effective to stop rotation of said auxiliary motor once said yarn reserve-forming means has reached first or second end-of travel positions, thereby also stopping rotation in said second direction of said yarn take-up means also driven by said auxiliary motor.

6. Improved means according to claim 5, wherein said mechanical drive connection means includes a clutch, and means for disengaging said clutch when said first limit switch is operated by engagement with said nut.

7. Improved means for starting a spinning operation in an open-end spinning machine, including (a) spinning means for spinning a yarn;

(b) fibre feed means for feeding fibres to said spinning means;

(c) yarn take-up means for taking-up or receiving said spun yarn, including a pair of yarn delivery rollers and a yarn take-up package spaced from said rollers to define therebetween space for a yarn path extending therebetween;

(d) drive means for rotating said yarn take-up means in a first direction to receive and deliver said yarn from said spinning means;

(e) yarn reserve-forming means for forming a reserve length of yarn to be used in said starting, said forming means including a drive arm, and effective for forming said reserve length of yarn within said space in a yarn path between said yarn delivery rollers and said spinning means;

(f) mechanical drive connection means for interconnecting said yarn reserve-forming means with said yarn take-up means for ensuring movement of said yarn reserve-forming means during a building phase of said reserve length of yarn at a controlled rate in accordance with the rate of paying out said yarn from said yarn take-up means upon motion of said yarn take-up means in a second direction opposite to said first direction; and (g) control means for controlling said drive means to rotate said yarn take-up means at a controlled first rate in said second direction opposite to said first direction, for controlling and causing simultaneous movement of said reserve-forming means in a direction so as to form said reserve length of yarn from said paid out yarn withdrawn from said yarn take-up means in another direction so as to pay-out the thus-formed reserve length of yarn of a controlled rate;

wherein said mechanical drive connection means includes a lead screw and a nut thereon which is engageable with said drive arm, and further wherein there is an auxiliary motor interconnected with said lead screw for driving the same and which also is interconnected with said yarn take-up driving the same in said second direction, the driving of said yarn take-up means in said first direction being effected by a main motor separate from said auxiliary motor.

8. Improved means according to claim 7, including first and second limit switches co-operable with said nut and said drive arm and effective to stop rotation of said auxiliary motor once the yarn reserve-forming means has reached first and second end-of-travel positions, thereby also stopping rotation in the second direction of the yarn take-up means also driven by said auxiliary motor.

9. Improved means according to claim 8, wherein said mechanical drive connection means includes a clutch, and means for disengaging said clutch when said first limit switch is operated by engagement with the nut.

* * * * *